US005364545A

United States Patent [19]

Arai et al.

[11] Patent Number: 5,364,545

[45] Date of Patent: Nov. 15, 1994

[54] LUBRICATING OIL COMPOSITION CONTAINING FRICTION MODIFIER AND CORROSION INHIBITOR

[75] Inventors: Katsuya Arai; Toshikazu Tsukada, both of Ohi; Hirotaka Tomizawa, Tokorozawa, all of Japan

[73] Assignee: Tonen Corporation, Saitama, Japan

[21] Appl. No.: 89,130

[22] Filed: Jul. 9, 1993

[51] Int. Cl.[5] ..... C10M 137/00

[52] U.S. Cl. ..... 252/32.7 R; 252/49.7; 252/42.7

[58] Field of Search ..... 252/49.7, 42.7, 32.7 R

[56] References Cited

U.S. PATENT DOCUMENTS 3,251,661 5/1966 Retzloff et al. ..... 252/46.4
4,201,683 5/1980 Brewster ..... 252/49.7
4,529,526 7/1985 Inoue et al. ..... 252/32.7
4,889,647 12/1989 Rowan et al. ..... 252/42.7

*Primary Examiner*—John Niebling
*Assistant Examiner*—Edna Wong
*Attorney, Agent, or Firm*—James H. Takemoto

[57] ABSTRACT

An improved lubricating oil composition having a low coefficient of friction and reduced copper corrosion comprising (a) a lubricating oil basestock, (b) from 0.01 to 10% by weight, based on the oil composition, of at least one organomolybdenum compound selected from the group consisting of oxymolybdenum monoglyceride and oxymolybdenum diethylatoamide; and (c) from 0.5 to 7% by weight, based on the oil composition, of at least one organozinc compound selected from the group consisting of zinc dithiophosphate and zinc dithiocarbamate.

6 Claims, No Drawings

LUBRICATING OIL COMPOSITION CONTAINING FRICTION MODIFIER AND CORROSION INHIBITOR

BACKGROUND OF THE INVENTION

1. Field of the Invention

This invention relates to a lubricating oil composition having a low coefficient of friction and a reduced copper corrosiveness.

2. Description of the Related Art

In recent years, an increase in the output of internal combustion engines such as automobile engines has caused individual parts of the engine, for example valve operating systems and cylinders, to be exposed to high temperatures. Moreover, the number of contacts per unit time of metals with each other has been increased, thus placing the internal combustion engine under severe operating conditions. Lubricating oils for internal combustion engines must function under severe operating conditions. With a reduction in engine size and an increase in the performance which results in an increase in the number of revolutions and an increase in the output, engine oils are required to be versatile and possess high levels of performance.

Examples of fundamental performances required of the engine oils include detergency, dispersancy, a reduction in the friction, prevention of abrasion and seizing, reduction of thermal and oxidative deterioration, reduction of corrosion, and cooling and sealing functions. For example Japanese Patent Publication No. 23595/1991 proposes a lubricating oil composition particularly useful in the reduction in the mechanical friction loss of four-cycle engines, said lubricating oil composition comprising a mineral oil and/or a synthetic oil having a kinematic viscosity at 100 degrees C. of 3 to 20 cSt and, incorporated therein, (a) 0.2 to 5% by weight of sulfurized oxymolybdenum organophosphorodithioate (hereinafter abbreviated to "MoDTP" and/or molybdenum dithiocarbamate (hereinafter abbreviated to as "MoDTC"), (b) 0.1 to 7% by weight of zinc dithiophosphate, (c) 0.1 to 20% by weight of calcium alkylbenzenesulfonate and (d) 1 to 15% by weight of an alkenylsuccinimide and/or a boron compound derivative of an alkenylsuccinimide. According to this lubricating oil composition, the coefficient of friction in the mixed/boundary region can be reduced to about $\frac{1}{3}$ of that for the conventional engine oil.

One of the important features of the lubricating oil is that the lubricating oil does not attack a metal present within the engine during use. Free sulfur, sulfur compounds, or acidic substances are considered to cause corrosion. Since a copper plate is most sensitive to these substances, the corrosion of a copper plate when exposed to lubricating oil is evaluated as a measure of the corrosiveness of the lubricating oil. It is a common practice to add nitrogenous metal deactivators, such as benzotriazole, to the lubricating oil for the purpose of reducing the copper corrosiveness. However, the addition of these metal deactivators in a large amount results in hardening of sealing rubbers.

On the other hand, when MoDTP or MoDTC is added in a relatively large amounts of 0.2 to 5% by weight as disclosed in the above-cited Japanese Patent publication for the purpose of reducing the friction, the copper corroding activity is unacceptably increased.

Further, lubricating oils containing organomolybdenum compounds, such as MoDTP or MoDTC, have a problem of a high coefficient of friction at an early stage, i.e., at the stage of running-in. The additive to the lubricating oil is adsorbed on the surface of the metal to form a boundary lubrication film which serves to reduce boundary friction. However, a relatively substantial amount of time is taken for the organomolybdenum compounds to be adsorbed on the surface of the metal to develop the effect of reducing the friction.

When lubricating oil compositions containing the organomolybdenum compounds are used as an engine oil, the effect of reducing the friction develops after running a distance of 2000 to 3000 km, although this depends upon the running conditions of automobiles. However, after the above-described running, the time for the development of the effect of reducing the friction often overlaps with the time for the replacement of the engine oil. In such a case, an increase in the amount of addition of MoDTP or MoDTC does not lead to the development of the effect of reducing the friction at an earlier stage and rather increases the copper corrosiveness.

It would be desirable to provide a lubricating oil composition having a low coefficient of friction and a reduced copper corrosiveness. It would also be desirable to provide a lubricating oil composition which exhibits a low coefficient of friction from an early stage and has reduced copper corrosiveness.

SUMMARY OF THE INVENTION

The present invention relates to improved lubricating oil compositions having a low coefficient of friction, reduced copper corrosivity and which exhibit a low coefficient of friction from an early operating stage. The lubricating oil composition comprises:

(a) a lubricating oil basestock;

(b) from 0.01 to 10% by weight, based on the oil composition, of at lease one organomolybdenum compound selected from the group consisting of oxymolybdenum monoglyceride and oxymolybdenum diethylateamide; and (c) from 0.5 to 7% by weight, based on the oil composition, of at least one organozinc compound selected from the group consisting of zinc dithiophosphate and zinc dithiocarbamate.

In another embodiment, the lubricating oil composition further comprises from 0.01 to 5% by weight, based on the composition, of an organic acid amide. The present invention is also directed to a method for reducing friction in an internal combustion engine which comprises operating the engine with the lubricating oil composition containing components (a)-(c) above.

DETAILED DESCRIPTION OF THE INVENTION

The mineral oil and/or synthetic oil used as a base oil in the lubricating oil composition of the present invention has a kinematic viscosity of 3 to 20 cSt at 100° C., preferably 4 to 15 cSt. Examples of the mineral oil include 60 neutral oil, 100 neutral oil, 150 neutral oil, 300 neutral oil, 500 neutral oil and a bright stock. Examples of the synthetic oils include polyolefin, polyglycol ester, polyol ester, phosphoric ester, silicone oil, alkyldiphenyl, alkylbenzene and dibasic acid ester. These base oils may be used alone or in the form of a mixture of two or more of them.

The Mo oxide compounds used in the present invention are oxymolybdenum monoglyceride represented by the following general formula I and oxymolybdenum diethylatoamide represented by the following general formula II:

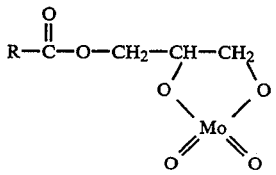

[I]

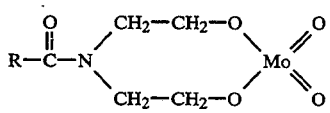

[II]

In the general formulae I and II, R is a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having from 3 to 20 carbon atoms and containing an ester bond, an ether bond, an alcoholic group or a carboxyl group.

In the general formulae I and II, R is preferably a saturated or unsaturated alkyl or alkenyl group having 6 to 18 carbon atoms, a cycloalkyl group having 12 to 24 carbon atoms or an alkylaryl group having 12 to 24 carbon atoms. Preferred examples thereof include alkyl and alkenyl groups having 6 to 18 carbon atoms, such as n-hexyl, 2-ethyl hexyl , n-octyl, nonyl, decyl, lauryl, tridecyl, oleyl and linoleyl, and alkylaryl groups substituted with an alkyl group having 3 to 18 carbon atoms, such as nonylphenyl.

The amount of the commercially available Mo oxide compounds is 0.01 to 10% by weight, preferably 0.05 to 8% by weight, based on the oil composition independently of whether they are used alone or in combination thereof. When the amount is less than 0.01% by weight, no satisfactory effect of reducing the friction can be attained. On the other hand, when the amount is excessively high, the effect of reducing the friction is saturated.

ZnDTP and ZnDTC used in the present invention are organozinc compounds respectively represented by the following general formulae III and IV:

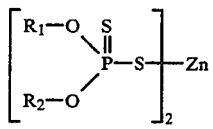

[III]

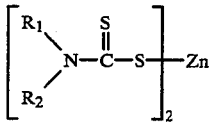

[IV]

In the general formulae III and IV, $R_1$ and $R_2$ may be the same or different and each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having from 3 to 20 carbon atoms and containing an ester bond, an ether bond, an alcohol group or a carboxyl group.

In the general formulae III and IV, $R_1$ and $R_2$ are preferably independently an alkyl group having 2 to 12 carbon atoms, a cycloalkyl group having 8 to 18 carbon atoms and an alkylaryl group having 8 to 18 carbon atoms.

ZnDTP and ZnDTC are commercially available from Amoco Chemical Co. and Exxon Chemical Co. and are incorporated either alone or in combination in an amount of 0.5 to 7% by weight based on the oil composition. These compounds serve as an extreme-pressure agent, an antioxidant, a corrosion inhibitor, etc. When the amount of these compounds incorporated into the oil composition is excessively low, no satisfactory effect of addition can be attained. On the other hand, when it is excessively high, the effect of addition is often saturated or even lowered.

The organic amide used in the present invention is a compound represented by the following general formula V:

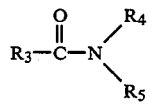

[V]

In the general formula V, $R_4$ and $R_5$ may be the same or different and for each is independently a hydrogen atom; an alkyl group having 1 to 20 carbon atoms; a cycloalkyl group having 6 to 26 carbon atoms; an aryl, alkylaryl or arylalkyl group having 6 to 26 carbon atoms; or an alkylene oxide group having 2 to 30 carbon atoms, and $R_3$ stands for a hydrogen atom; an alkyl group having 1 to 20 carbon atoms; a cycloalkyl group having 6 to 26 carbon atoms; an aryl, alkylaryl or arylalkyl group having 6 to 26 carbon atoms; or a hydrocarbon group having from 3 to 20 carbon atoms and containing an ester bond, an ether bond, an alcohol group or a carboxyl group.

The term "alkylene oxide group" used herein is intended to mean groups represented by the following general formula VI and/or VII:

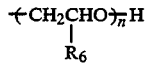

[VI]

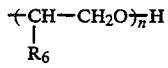

[VII]

In the general formulae VI and VII, n is an integer of 1 to 10, and $R_6$ stands for a hydrogen atom or a methyl group.

In the general formula V, $R_4$ and $R_5$ are preferably independently a hydrogen atom, an alkyl group having 2 to 8 carbon atoms, a cycloalkyl group having 8 to 14 carbon atoms, an alkylaryl group having 8 to 14 carbon atoms or an alkylene oxide group wherein n is 1 to 5. In the general formula V, $R_3$ preferably stands for a saturated or unsaturated alkyl group having 6 to 18 carbon atoms, a cycloalkyl group having 12 to 24 carbon atoms or an alkylaryl group having 12 to 24 carbon atoms. Examples of such an organic amide compound include oleamide and lauramide.

The amount of the organic amide compound is 0.01 to 5% by weight, preferably 0.05 to 2% by weight based on the oil corporation. The addition of the organic amide compound enables the coefficient of friction to be lowered from an early stage while preventing copper corrosion. If the amount is excessively low, the effect of lowering the coefficient of friction in an early stage is small. On the other hand, if the amount is excessively high, the effect is saturated.

If desired, other additives, for example, other extreme-pressure agents, ashless detergent dispersants, antioxidants, metal cleaners, metal deactivators, viscosity index improvers, pour point depressants, rust preventives, antifoaming agents, and corrosion preventives, may be added to the lubricating oil composition.

Examples of other extreme-pressure agent include organomolybdenum compounds such as sulfurized oxymolybdenum dithiocarbamate (MoDTC) and sulfurized oxymolybdenum organophosphorodithioate (MoDTP). These organomolybdenum compounds are generally used in an amount from 0.01 to less than 0.2% by weight, based on oil composition. When the proportion of MoDTC and MoDTP is above the above-described range, the copper corrosiveness becomes significant.

Examples of the ashless detergent dispersant include those based on succinimide, succinamide, benzylamine and esters, and it is also possible to use boron-base ashless detergent dispersants. They are generally used in an amount of from 0.5 to 7% by weight, based on oil composition.

Examples of the antioxidant include amine-based antioxidants, such as alkylated diphenylamine, phenyl-a-naphthylamine and alkylated a-naphthylamine, and phenolic antioxidants, such as 2,6-di-tert-butylphenol and 4,4'-methylenebis-(2,6-di-tert-butylphenol), and they are generally used in an amount of from 0.05 to 2% by weight based on oil composition.

Examples of the metal cleaner include Ca sulfonate, Mg sulfonate, Ba sulfonate, Ca phenate and Ba phenate, which are generally used in an amount of from 0.1 to 5% by weight, based on oil composition.

Examples of the metal deactivator include benzotriazole, benzotriazole derivatives, benzothiazole, benzothiazole derivatives, triazole, triazole derivatives, dithiocarbamate, dithiocarbamate derivatives, indazole and indazole derivatives, which are generally used in an amount from 0.0005 to 0.3% by weight based on oil composition.

Examples of the viscosity index improver include polymethyl methacrylate, polyisobutylene, ethylene-propylene copolymer and styrene-butadiene hydrogenated copolymer, which are generally used in an amount of from 0.5 to 35% by weight, based on oil composition.

Examples of the rust preventive include an alkenylsuccinic acid and a partial ester thereof, which is added as needed.

Examples of the anti foaming agent include dimethylpolysiloxane and polyacrylate, which is added as needed.

The lubricating oil composition of the present invention can be produced by incorporating the desired amount of the above-described various additives to a mineral oil and/or a synthetic oil as a base oil and homogeneously mixing them with each other. The lubricating oil composition of the present invention can be used in extensive fields as lubricating oils including engine oils and, further, gear oils, ATF, PS fluids, spindle oils, hydraulic oils, industrial oils, etc.

The present invention is further illustrated with reference to the following Examples which include a preferred embodiment of the invention.

The properties of the lubricating oils were measured by the following methods.

Measurement of Coefficient of Friction

The coefficient of friction of each lubricating oil was measured with a reciprocal vibration friction tester (SRV).

In the SRV tester, a steel ball having a diameter of ½ in. (SUJ-2 specified in JIS G 4805) was used as the upper test piece, and a steel disk (SUJ-2 specified in JIS G 4805) was used as the lower test piece. A sample oil was dropped on the lower test piece, a load was applied to the upper test piece from the top, and the upper test piece was vibrated parallel to the lower test piece with the upper test piece being pressed against the lower test piece. The lateral load applied to the lower test piece was measured to calculate the coefficient of friction ($\mu$). The coefficient of friction was measured twice, that is, 5 min and 20 min after the initiation of the vibration of the upper test piece. Testing conditions were as follows:

load: 100N,
temperature: 130° C.,
frequency: 8 Hz, and
amplitude: 4 mm.

Copper Corrosiveness

A corrosiveness test was conducted at a testing temperature of 100° C. and a testing time of 3 h by the test tube method according to JIS K 2513 "Petroleum Products—Corrosiveness to Copper—Copper Strip Test" and the state of discoloration of the copper plate was observed according to the Standard for Copper Plate Corrosion to evaluate and the corrosiveness according to subdivisional symbols 1a to 4c. The smaller the number, the lower the corrosiveness, and the corrosiveness increases in alphabetical order.

Specific evaluation examples are as follows:

1a: a pale orange color which is substantially the same as the color of a finish-polished copper plate,
1b: a deep orange color, and
3a: a reddish brown pattern on the brass color.

EXAMPLES 1 TO 6 AND COMPARATIVE EXAMPLES 1 AND 2

4% by weight of Ca sulfonate, 5% by weight of succinimide, 0.5% by weight of an alkylated diphenylamine, 0.3% by weight of 2,6-di-tert-butylphenol and 0.2% by weight of 5-methyl-benzotriazole were incorporated into a mineral oil (150 neutral mineral oil; kinematic viscosity at 100$_X$ C of 5.1 cSt), and the various components listed in Table 1 were added thereto to prepare lubricating oil compositions. The amount in % by weight of each component is based on the oil composition, and the balance is the amount in % by weight of the mineral oil. The results of measurement of the properties are given in Table 1.

Individual components are described as follows:

(1) Mo oxide Compound

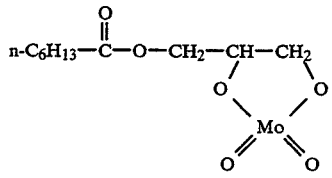

(2) MoDTC (Sakura-Lube ® manufactured by Asahi Denka Kogyo K.K.)

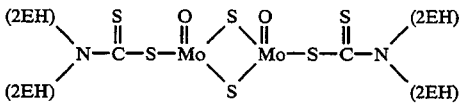

wherein 2EH stands for a 2-ethylhexyl group, (3) MoDTP (Molyvan L ® manufactured by R. T. Vanderbilt)

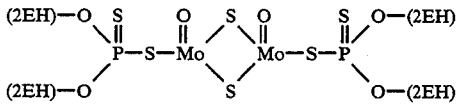

wherein 2EH stands for a 2-ethylhexyl group, (4) ZnDTP (Paranox 16 ® manufactured by Exxon Chemical Co.)

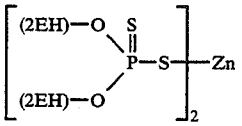

wherein 2EH stands for a 2-ethylhexyl group, (5) ZnDTC

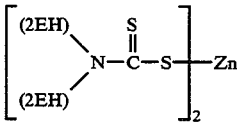

wherein 2EH stands for a 2-ethylhexyl group, (6) Ca sulfonate (Hitec 611 ® manufactured by Ethyl Corp.)

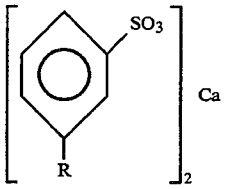

wherein R stands for an alkyl group having 10 carbon atoms, and (7) succinimide

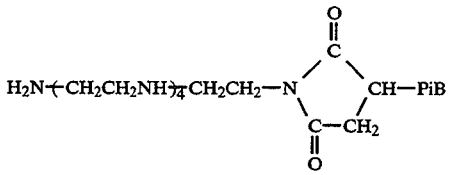

wherein PiB stands for polyisobutylene.

TABLE 1

| | Examples | | | | | | Comparative Examples | |
|---|---|---|---|---|---|---|---|---|
| | 1 | 2 | 3 | 4 | 5 | 6 | 1 | 2 |
| Mo Oxide Compound | 0.7* | 3.0 | 2.0 | 3.0 | 0.7 | 1.0 | — | 1.0 |
| MoDTC | — | — | 0.07 | — | — | — | 0.30 | — |
| MoDTP | — | — | — | 0.10 | — | — | — | — |
| ZnDTP | 2.0 | 3.0 | 2.0 | 2.0 | 2.0 | 2.0 | 2.0 | — |
| ZnDTC | — | 1.0 | — | 0.5 | — | — | — | — |
| Oleic amide | — | — | — | — | 0.5 | — | — | — |
| Lauramide | — | — | — | — | — | 0.5 | — | — |
| Friction Coefficient () | | | | | | | | |
| After 5 min. | 0.13 | 0.13 | 0.13 | 0.11 | 0.05 | 0.06 | 0.13 | 0.14 |
| After 20 min. | 0.06 | 0.05 | 0.05 | 0.05 | 0.04 | 0.05 | 0.11 | 0.65 |
| Copper Corrosion | Ia | Ia | Ia | Ib | Ia | Ia | 3a | Ia |

*percent by weight based on the oil compositon

As is apparent from Table 1, each of the lubricating oil compositions of Examples 1 to 4 of the present invention had a small coefficient of friction 20 min after the initiation of the test and, at the same time, a small copper corrosiveness. By contrast, the lubricating oil composition of Comparative Example 1 wherein MoDTC was incorporated in an amount of 0.30% by weight had a large coefficient of friction 20 min after the initiation of the test and, at the same time, a large copper corrosiveness. Further, the lubricating oil composition of Comparative Example 2 wherein neither ZnDTP nor ZnDTC was used in combination with Mo oxide compounds had a tendency that the coefficient of friction increases with time.

Further, it is apparent that each of the lubricating oil compositions of Examples 5 and 6 wherein an organic amide compound was also used had a small coefficient of friction 5 min after the initiation of the test, which suggests that these lubricating oil compositions exhibit the effect of reducing the friction from the beginning.

What is claimed is:

1. A lubricating oil composition having a low coefficient of friction, reduced copper corrosivity and which exhibits a low coefficient of friction from an early operating stage which consists essentially of:

a) a lubricating oil basestock:

b) from 0.01 to 10% by weight, based on the oil composition, of at least one organomolybdenum compound selected from the group consisting of oxymolybdenum monoglyceride and oxymolybdenum diethylateamide;

c) from 0.5 to 7% by weight, based on the oil composition, of at least one organozinc compound selected from the group consisting of zinc dithiophosphate and zinc dithiocarbamate; and d) from 0.01 to 5% by weight, based on the oil composition, of an organic amide having a general formula;

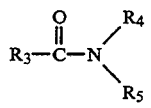

wherein $R_4$ and $R_5$ are different and each is independently a hydrogen atom; an alkyl group containing from 1 to 20 carbon atoms, a cycloalkyl group containing from 6 to 26 carbon atoms, an aryl group, an alkylaryl group or an arylalkyl group containing from 6 to 26 carbon atoms; or an alkylene oxide containing from 2 to 30 carbon atoms; and $R_3$ is a hydrogen atom; an alkyl group containing from 1 to 20 carbon atoms, a cycloalkyl group containing from 6 to 26 carbon atoms; an aryl group, an alkylaryl group or an arylalkyl group containing from 6 to 26 carbon atoms; a hydrocarbon group having from 3 to 20 carbon atoms and containing an ester group, an ether group, an alcohol group, or a carboxyl group.

2. The oil composition of claim 1 wherein the oxymolybdenum glyceride and oxymolybdenum diethylateamide have the respective formulae:

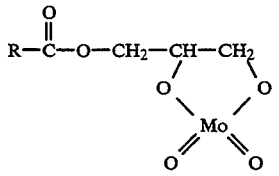

(I)

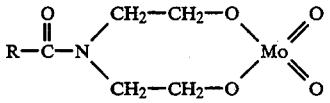

(II)

wherein R is hydrogen atom; an alkyl group containing from 1 to 20 carbon atoms; a cycloalkyl group containing from 6 to 26 carbon atoms; an aryl group, an alkylaryl group or an arylalkyl group containing from 6 to 26 carbon atoms; a hydrocarbon group having from 3 to 20 carbon atoms and containing an ester group, and ether group, an alcohol group or a carboxyl group.

3. The oil composition of claim 1 wherein zinc dithiophosphate and zinc dithiocarbamate have the respective formulae:

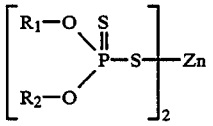

(III)

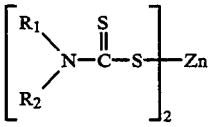

(IV)

wherein each of $R_1$ and $R_2$ is independently a hydrogen atom; an alkyl group containing from 1 to 20 carbon atoms; a cycloalkyl group containing from 6 to 26 carbon atoms; an aryl group, an alkylaryl group, or an arylalkyl group containing from 2 to 30 carbon atoms; or a hydrocarbon group having from 3 to 20 carbon atoms and containing an ester group, an ether group, an alcohol group or a carboxyl group.

4. A method for reducing friction from an early operating stage and reducing copper corrosion in an internal combustion engine which comprises operating the engine with a lubricating oil composition which consists essentially of:

a) a lubricating oil basestock:

b) from 0.01 to 10% by weight, based on the oil composition, of at least one organomolybdenum compound selected from the group consisting of oxymolybdenum monoglyceride and oxymolybdenum diethylateamide;

c) from 0.5 to 7% by weight, based on the oil composition, of at least one organozinc compound selected from the group consisting of zinc dithiophosphate and zinc dithiocarbamate; and d) from 0.01 to 5% by weight, based on the oil composition, of an organic amide having a general formula;

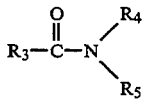

wherein $R_4$ and $R_5$ are the same or different and each is independently a hydrogen atom; an alkyl group containing from 1 to 20 carbon atoms, a cycloalkyl group containing from 6 to 26 carbon atoms, an aryl group, an alkylaryl group or an arylalkyl group containing from 6 to 26 carbon atoms; or an alkylene oxide containing from 2 to 30 carbon atoms; and $R_3$ is a hydrogen atom; an alkyl group containing from 1 to 20 carbon atoms, a cycloalkyl group containing from 6 to 26 carbon atoms; an aryl group, an alkylaryl group or an arylalkyl group containing from 6 to 26 carbon atoms; a hydrocarbon group having from 3 to 20 carbon atoms and containing an ester group, an ether group, an alcohol group or a carboxyl group.

5. The oil composition of claim 1 wherein $R_3$ is a saturated or unsaturated alkyl group having 6 to 18 carbon atoms, a cycloalkyl group having 12 to 24 carbon atoms or an alkylaryl group having 12 to 24 carbon atoms; $R_4$ and $R_5$ are independently a hydrogen atom, an alkyl group having 2 to 8 carbon atoms, a cycloalkyl group having 8 to 14 carbon atoms, an alkylaryl having 8 to 14 carbon atoms, or an alkylene oxide group selected from at least one of

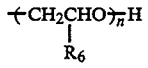

and

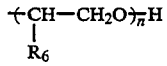

wherein n is 1 to 5 and $R_6$ is a hydrogen atom or a methyl group.

6. The oil composition of claim 1 further comprising a sulfurized oxymolybdenum dithiocarbamate and sulfurized oxymolybdenum organophosphorodithioate.

* * * * *